United States Patent [19]

Berchem

[11] Patent Number: 4,510,706

[45] Date of Patent: Apr. 16, 1985

[54] CUTTING-TOOTH ANCHOR FOR SUCTION DREDGE AND METHOD OF MAKING SAME

[75] Inventor: Rütger Berchem, Gelsenkirchen, Fed. Rep. of Germany

[73] Assignee: Berchem & Schaberg GmbH, Gelsenkirchen, Fed. Rep. of Germany

[21] Appl. No.: 568,607

[22] Filed: Jan. 6, 1984

[30] Foreign Application Priority Data

Jan. 8, 1983 [DE] Fed. Rep. of Germany ..... 3300467

[51] Int. Cl.[3] ..... E02F 9/28

[52] U.S. Cl. ..... 37/64; 37/141 T; 72/325; 72/377; 75/123 J; 75/123 N

[58] Field of Search ..... 29/DIG. 17, DIG. 18; 72/377, 356, 325; 75/123 N, 123 J; 37/141 R, 141 T, 142 R, 142 A, 67, 64

[56] References Cited

U.S. PATENT DOCUMENTS

| | | | |
|---|---|---|---|
| Re. 17,846 | 10/1930 | Brown | 75/123 J X |
| 1,007,941 | 11/1911 | Hansen | 72/325 |
| 1,685,678 | 9/1928 | Mirfield | 72/325 |
| 2,289,081 | 7/1942 | Shortell et al. | 75/123 J X |
| 2,576,223 | 11/1951 | Hofmann | 75/123 J |
| 2,827,275 | 3/1958 | Krekeler et al. | 72/377 X |
| 2,865,740 | 12/1958 | Heger et al. | 75/123 J |
| 3,314,278 | 4/1967 | Bergman | 72/377 |
| 3,896,567 | 7/1975 | Leoben et al. | 37/141 R X |
| 4,231,173 | 11/1980 | Davis | 37/142 R |
| 4,319,415 | 3/1982 | Mayerbock et al. | 37/67 |

*Primary Examiner*—Clifford D. Crowder

*Attorney, Agent, or Firm*—Karl F. Ross; Herbert Dubno

[57] ABSTRACT

An anchor for a cutting tooth of a suction dredge comprises a unitary body to be welded onto the periphery of a suction head, this body having a base with a crenellated rim surrounding a tapering head designed to penetrate into a cavity of the cutting tooth. The head has a throughgoing slot alignable with similar cutouts of two lobes of the tooth receivable between crenellations of the body to accommodate a key for retaining the tooth on the head. The body consists of high-strength ductile steel, preferably alloyed with manganese and vanadium, and is formed by forging with the grains of its structure running from the base toward the tip of the head while bending around the slot thereof, the latter being produced by hot forming without chip removal.

6 Claims, 4 Drawing Figures

CUTTING-TOOTH ANCHOR FOR SUCTION DREDGE AND METHOD OF MAKING SAME

FIELD OF THE INVENTION

My present invention relates to a suction dredge and, more particularly, to a suction head of such a dredge provided with a multiplicity of welded-on anchors for the support of respective cutting teeth to be mounted on the periphery of that head.

BACKGROUND OF THE INVENTION

Since the cutting teeth of such a suction head are prone to wear, they should be readily replaceable. For this purpose it is known to provide the welded-on tooth anchors and the teeth themselves with aligned slots to be traversed by removable retaining keys. For proper alignment, the teeth and their anchors are to have interfitting formations which usually are designed as scalloped or crenellated ledges on the anchor and lobes on the tooth projecting into the indentations defined by the crenellations. The crenellated ledge forms a rim of a base by which the anchor is to be welded onto the periphery of the suction head, this rim surrounding a head which projects from the base beyond that rim and tapers toward a remote tip so as to fit into a complementary concavity of the tooth. The head has a throughgoing slot in line with two diametrically opposite indentations in order to receive a retaining key passing through similar slots in corresponding lobes of the tooth.

In many instances the base of such a tooth anchor, on the one hand, and its head with the crenellated rim, on the other hand, are manufactured as separate parts to be subsequently welded together; the part comprising the head and the rim is sometimes referred to as a welded-on nose. This latter part may be unitarily cast or forged; the key slot, in either case, is produced by machining. It has also been proposed to cast the entire tooth anchor in one piece.

Tooth anchors made by any of these conventional processes have only a limited service life and are liable to crack, sooner or later, at the weld joint (if any) between the base and the nose or at the key slot. These tooth anchors, accordingly, are not well suited to withstand the stresses resulting from the demands of the industry for dredges with ever-increasing shaft power which nowadays may have to reach about 2200 hp or more, lying in a range which is some 25% higher than what was required not so long ago.

OBJECTS OF THE INVENTION

An important object of my present invention, therefore, is to provide an improved tooth anchor for a suction head of a dredge, of the general type referred to, which is able to sustain these higher stresses for a prolonged period.

A related object is to provide a method for producing such a tooth anchor.

SUMMARY OF THE INVENTION

I have found, in accordance with the present invention, that these objects can be realized with a cutting-tooth anchor which is unitarily forged from a piece of ductile steel having a yield strength of at least 120 kp/mm$^2$, provided that the forging is carried out in a manner yielding an oriented and generally continuous grain structure, with the grains running from the base to the tip. More particularly, the unitary anchor body—with a base, a crenellated rim and a head or nose as described above—is to have no discontinuities in that grain structure due to chip removal wherefore neither the key slot nor the indentations of the rim are to be machined. Thus, in contrast to conventional practice, the key slot is to be formed on the hot steel body by a punching operation opening a narrow gap parallel to the grains which is progressively widened to the requisite size whereby the adjoining grains will bend around the resulting slot instead of being ruptured. Similarly, the crenellated ledge or rim is to be formed by rabbeting and indenting without chip removal whereby the adjoining grains will bend around the resulting edges.

The way of imparting a desired grain orientation to a heated workpiece, through directional deformation, is of course well known in the forging art.

In an analogous manner, according to a preferred embodiment, the base of the tooth anchor may be bifurcated by forging—again without chip removal—to form a pair of prongs extending radially inward on the suction head and straddling a peripheral zone thereof. The grains, in that instance, will extend along substantially continuous lines from the free ends of the prongs to the tip of the head.

Though the present improvement lies essentially in the manufacturing process, the history of that process will be readily ascertainable on the finished tooth anchor from the longitudinal orientation and the substantial continuity of the grains in the structure of its steel body.

I have further found that, for best results in terms of service life and stress resistance, the body of the tooth anchor should be made from a weldable steel alloyed with minor proportions of manganese and vanadium. A preferred composition of such a steel is as follows (all percentages by weight):

1.6 to 2% Mn
0.6 to 1.5% V
0.35 to 0.5% C
balance iron and usual impurities.

BRIEF DESCRIPTION OF THE DRAWING

The above and other features of my invention will be described in detail with reference to the accompanying drawing in which.

SPECIFIC DESCRIPTION

Figure 1:
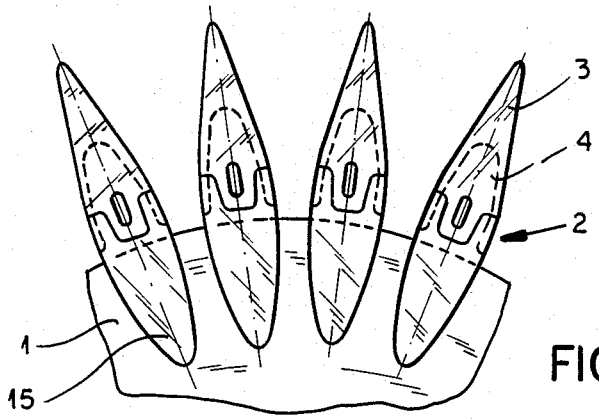
FIG. 1 is a somewhat diagrammatic fragmentary view of a suction head of a dredge with several cutting teeth mounted on respective tooth anchors made in accordance with my invention.

As seen in FIG. 1, a suction head 1—illustrated only in part—is provided with a multiplicity of tooth anchors 2 which are welded at angularly equispaced locations to its periphery and carry respective cutting teeth 3. Each anchor 2 has a base 6 terminating in a pair of prongs 15, best seen in FIG. 4, straddling a peripheral zone of the suction head 1 to which they are welded.

Figure 2:
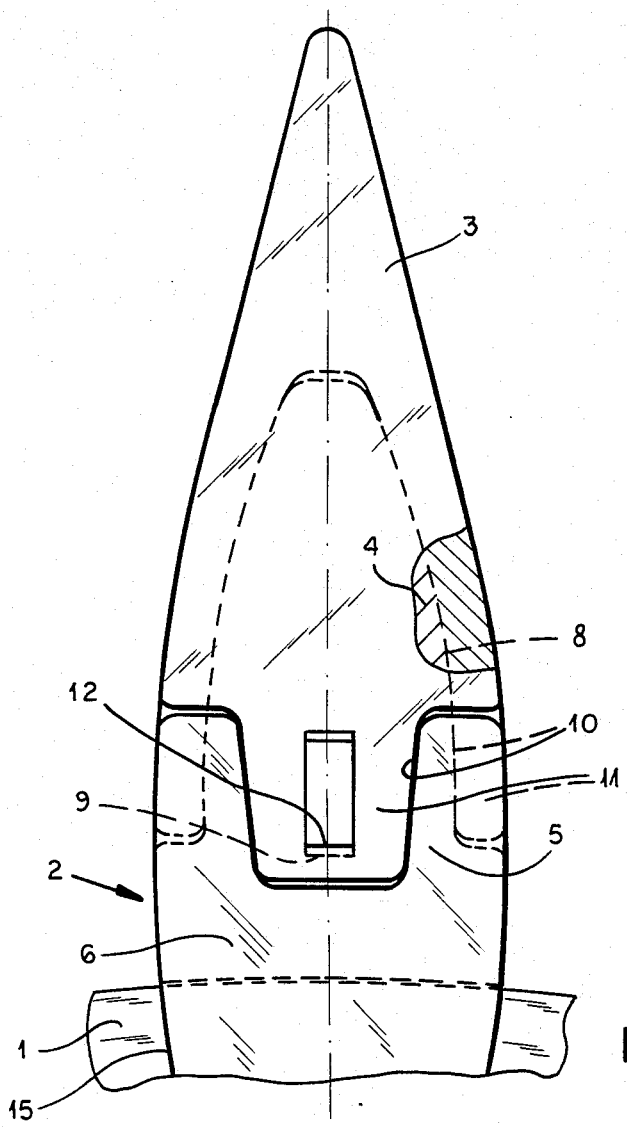
FIG. 2 is an elevational view, drawn to a considerably larger scale, of a major part of one of the tooth anchors of FIG. 1 with the associated cutting tooth in place.
Figure 3:
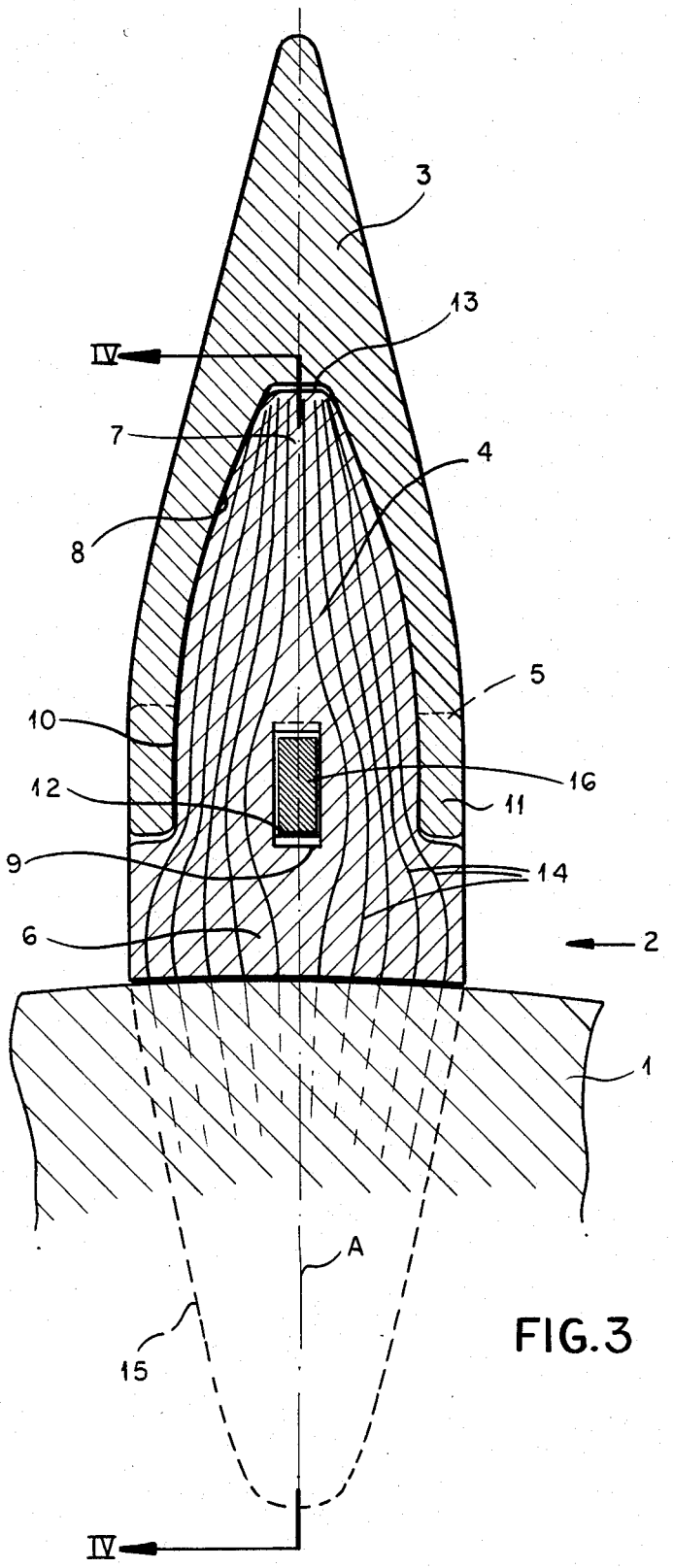
FIG. 3 is a longitudinal sectional view of the tooth-and-anchor assembly of FIG. 2.
Figure 4:
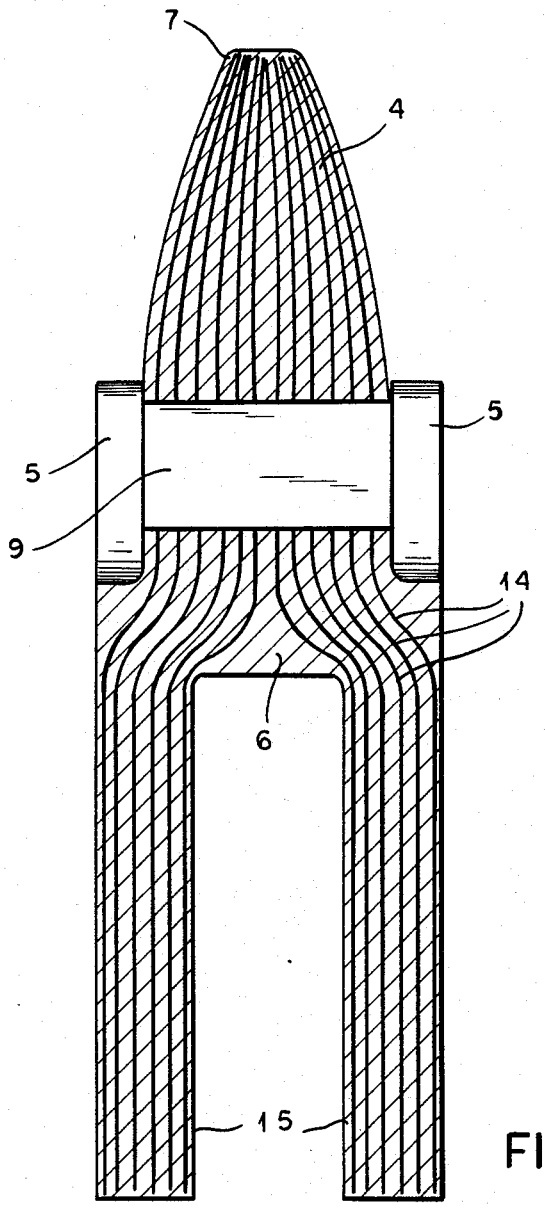
FIG. 4 is a sectional view of the tooth anchor taken on the line IV—IV of FIG. 3.

As more clearly illustrated in FIGS. 2–4, the generally cylindrical base 6 of a tooth anchor 2 has a crenellated rim 5 surrounding a lower part of a head or nose 4 which tapers toward a tip 7 with a flat end 13 and is received in a complementary cavity 8 of the associated cutting tooth 3. The latter has four peripherally spaced-apart lobes 11 received in complementary indentations 10 of the crenellated rim 5. Two of these lobes have rectangular cutouts 12 which register with a slot 9 passing diametrically through the part of nose 4 surrounded by the rim 5. Anchor 2 and tooth 3 are centered on a longitudinal axis A.

The entire body of tooth anchor 2, forged unitarily from manganese/vanadium steel as described above, has an oriented grain structure as diagrammatically indicated at 14 in FIGS. 3 and 4. Owing to the formation of key slot 9 without chip removal in the hot steel body as described above, the grain boundaries 14 are seen to bend around that slot as well as around inner and outer transverse edges formed by the prongs 15 and by the crenellations of rim 5.

I claim:

1. In a suction dredge provided with a suction head bearing a multiplicity of cutting-tooth anchors welded to the periphery thereof, the improvement wherein each of said anchors comprises an elongate unitary body of ductile steel with a yield strength of at least 120 kp/mm$^2$, said body having a base welded onto said periphery, a crenellated rim adjacent said base with radially outwardly open indentations, and a nose rising from said base beyond said rim within the crenellations thereof, said nose tapering toward a tip remote from said base and having a throughgoing transverse slot opening onto two diametrically opposite indentations of said rim, said body having an oriented structure with grains bending around said indentations and said slot, said base having a pair of radially inwardly extending prongs straddling a peripheral zone of said suction head, said grains extending along substantially continuous lines from the free ends of said prongs to said tip while also bending around said peripheral zone.

2. A cutting-tooth anchor as defined in claim 1 wherein said steel is alloyed with manganese and vanadium.

3. A cutting-tooth anchor as defined in claim 2 wherein said steel has a composition, by weight, consisting of substantially 1.6 to 2% manganese, 0.6 to 1.5% vanadium, 0.35 to 0.5% carbon, balance iron and usual impurities.

4. A method of producing a cutting-tooth anchor weldable onto a periphery of a suction head, comprising the steps of:

(a) heating a unitary piece of ductile steel, with a yield strength of at least 120 kp/mm$^2$, to a temperature enabling a shaping thereof by forging without chip removal;

(b) forging said piece into an elongate body having a base and a nose tapering from said base to a tip remote therefrom, with directional deformation imparting to said body a longitudinally oriented grain structure;

(c) rabbeting, in the course of said deformation, an intermediate peripheral zone of said body adjacent said base to form a crennellated rim around said nose with indentations open toward said tip; and (d) forming and widening, without chip removal, a slit in the heated body extending in said intermediate zone between two diametrically opposite indentations of said rim to produce a throughgoing slot adapted to receive a tooth-retaining key while keeping said grain structure substantially integral around the widened slit and said indentations.

5. A method as defined in claim 4 which comprises the further step of (e) splitting an end of the heated body opposite said tip, without chip removal, into two prongs forming integral extensions of said base adapted to straddle the periphery of said suction head, with maintenance of said grain structure substantially integral from the free ends of said prongs to said tip.

6. A method as defined in claim 4 wherein said steel has a composition, by weight, of substantially 1.6 to 2% manganese, 0.6 to 1.5% vanadium, 0.35 to 0.5% carbon, balance iron and usual impurities.

* * * * *